US008308617B2

(12) United States Patent
Jhang et al.

(10) Patent No.: US 8,308,617 B2
(45) Date of Patent: Nov. 13, 2012

(54) ELLIPTICAL TREADMILL WITH TORSIONAL SWINGING

(75) Inventors: A-Lan Jhang, Taichung (TW); Chien-Fu Fang, Taichung (TW)

(73) Assignee: Shang Jia Yu Co., Ltd., Taichung (TW)

( * ) Notice: Subject to any disclaimer, the term of this patent is extended or adjusted under 35 U.S.C. 154(b) by 0 days.

(21) Appl. No.: 12/906,415

(22) Filed: Oct. 18, 2010

(65) Prior Publication Data

US 2011/0105280 A1 May 5, 2011

(30) Foreign Application Priority Data

Nov. 2, 2009 (TW) ..... 98220210 U

(51) Int. Cl.
*A63B 22/04* (2006.01)

(52) U.S. Cl. ..... 482/52; 482/57

(58) Field of Classification Search ..... 482/51–53, 482/57–65, 70, 79–80
See application file for complete search history.

(56) References Cited

U.S. PATENT DOCUMENTS

| | | | | |
|---|---|---|---|---|
| 5,178,591 | A * | 1/1993 | Lyons | 482/52 |
| 5,378,209 | A * | 1/1995 | Kendrew | 482/52 |
| 6,719,666 | B1 * | 4/2004 | Lo et al. | 482/52 |
| 6,837,828 | B2 * | 1/2005 | Kyoung-chan et al. | 482/52 |
| 7,104,928 | B1 * | 9/2006 | Liu et al. | 482/52 |
| 7,303,509 | B2 * | 12/2007 | Schroder | 482/52 |
| 7,402,126 | B2 * | 7/2008 | Chang | 482/52 |
| 7,601,102 | B2 * | 10/2009 | Alessandri et al. | 482/52 |

* cited by examiner

*Primary Examiner* — Stephen Crow
(74) *Attorney, Agent, or Firm* — Egbert Law Offices, PLLC

(57) ABSTRACT

An elliptical exercise apparatus with a swinging effect has a pedals, a crank mechanism, a damping mechanism and pedals. A pair of sloping guide rails are arranged symmetrically between the front support and a middle support of a pedestal. One end of the pair of sloping guide rails is arranged laterally. A pair of pedals are arranged separately onto the pair of sloping guide rails and connected with the crank mechanism. A slide guide is steerably set at a front bottom of the pedals and slidably mated with the pair of sloping guide rails. A universal joint is set at the rear bottom of the pedals and is connected to the left and right cranks.

13 Claims, 8 Drawing Sheets

ELLIPTICAL TREADMILL WITH TORSIONAL SWINGING

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to elliptical exercise apparatus. More particularly, the present invention relates to elliptical exercise apparatus which allow a torsional swinging of the pedals.

2. Description of Related Art Including Information Disclosed Under 37 CFR 1.97 and 37 CFR 1.98.

Common fitness bikes have a generally circular pattern of pedal travel. Elliptical treadmills have an elliptical path of pedal travel which allows a simulation of running activities. The elliptical exercise apparatus is commonly is used in various fitness centers as an integral part of the fitness program.

In general, the elliptical exercise apparatus has a generally standard structure and pattern of movement. As such, the prior art has not brought about variations in the standard pattern of pedal travel.

BRIEF SUMMARY OF THE INVENTION

The present invention is an elliptical exercise apparatus that has a torsional swinging effect of the pedals. This allows a sloping guide rail to be arranged between a front support and a middle support of a pedestal. When the pedals are moved by the legs and feet of the user, the rear end of the pedals move in an arcuate or circular pattern under the drive of the left and right crank. The front end of the pedals can generate a reciprocating and torsional swinging movement because of the action of the pair of sloping guide rails. As such, the present invention is able to overcome the limitations of conventional elliptical exercise apparatus. In other words, the present invention enables the pedals to generate both elliptical and torsional swinging movements. This gives the user a different type of exercise and improves the fitness effect.

The sloping guide rail can be combined with the front and middle support at multiple sections adjustably. This will allow an adjustment of the movement of the pedals so as to meet the changing demands of the user.

Although the present invention has been described in this section in its preferred embodiment, it is to be understood that many other possible modifications and variations can be made without departing from the spirit and scope of the invention as hereinafter claims.

DETAILED DESCRIPTION OF THE INVENTION

Figure 1:
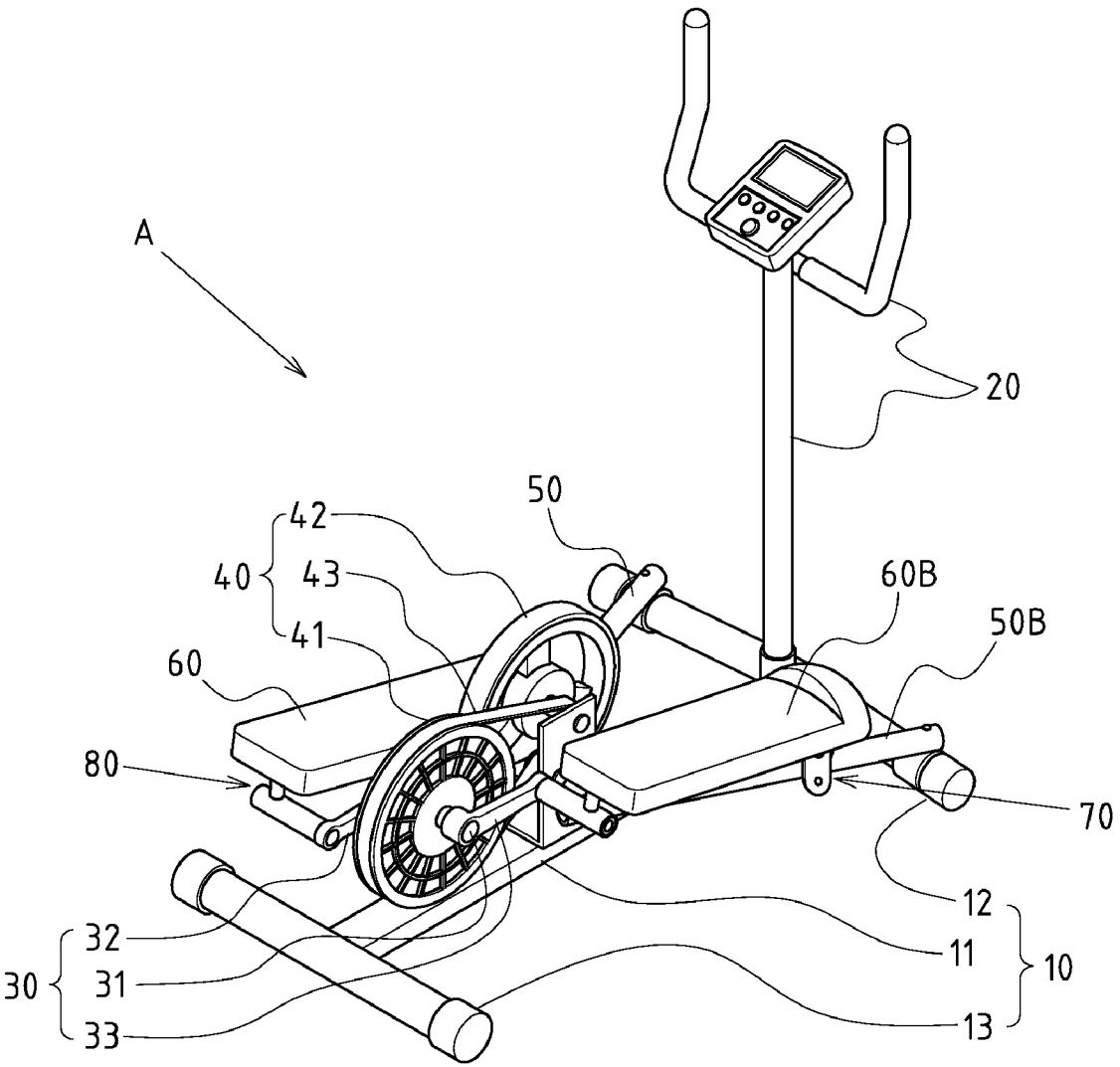
FIG. 1 is an assembled perspective view of the preferred embodiment of the elliptical exercise apparatus of the present invention.
Figure 2:
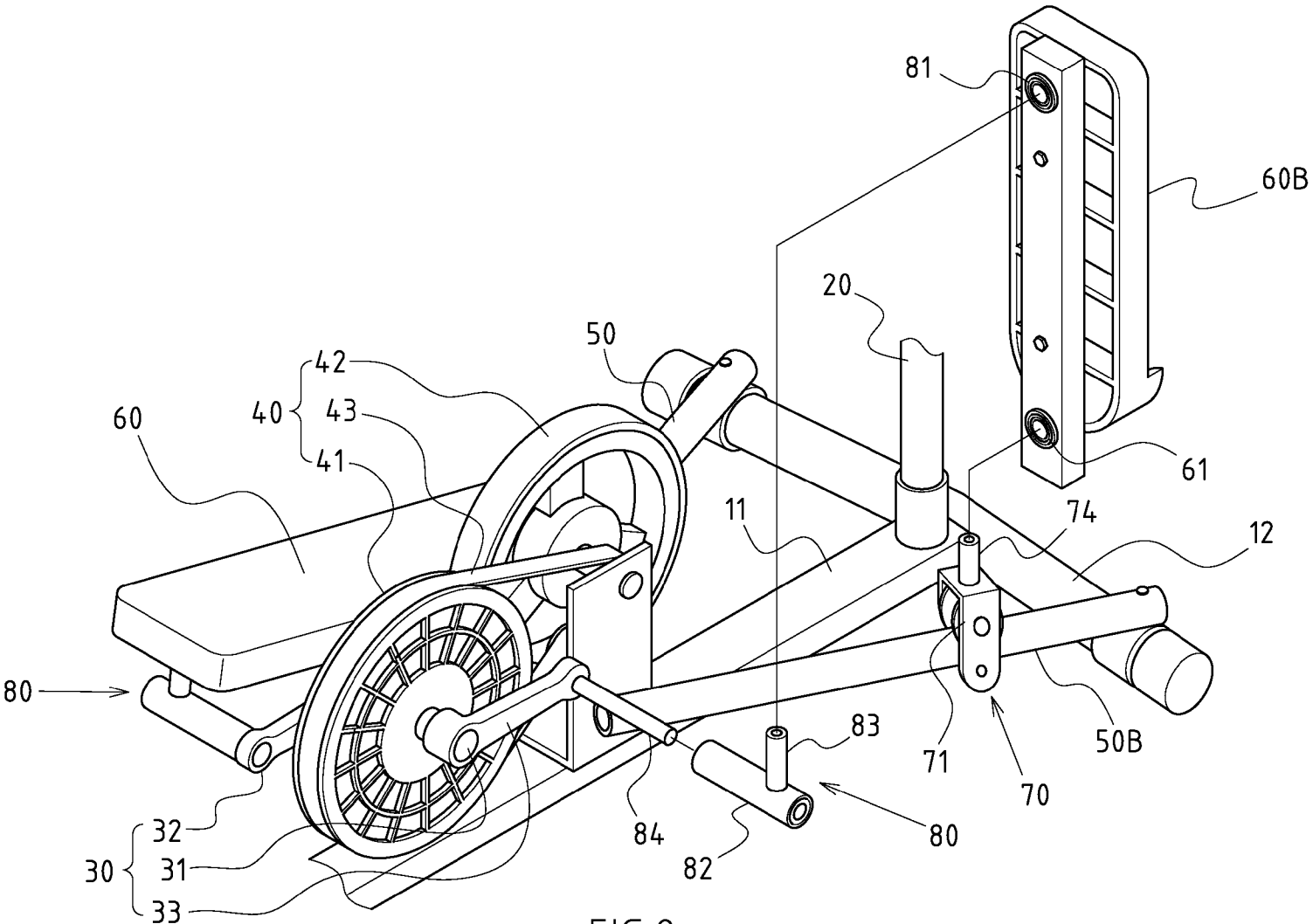
FIG. 2 is a partial exploded perspective view of the preferred embodiment of the elliptical exercise apparatus of the present invention.
Figure 3:
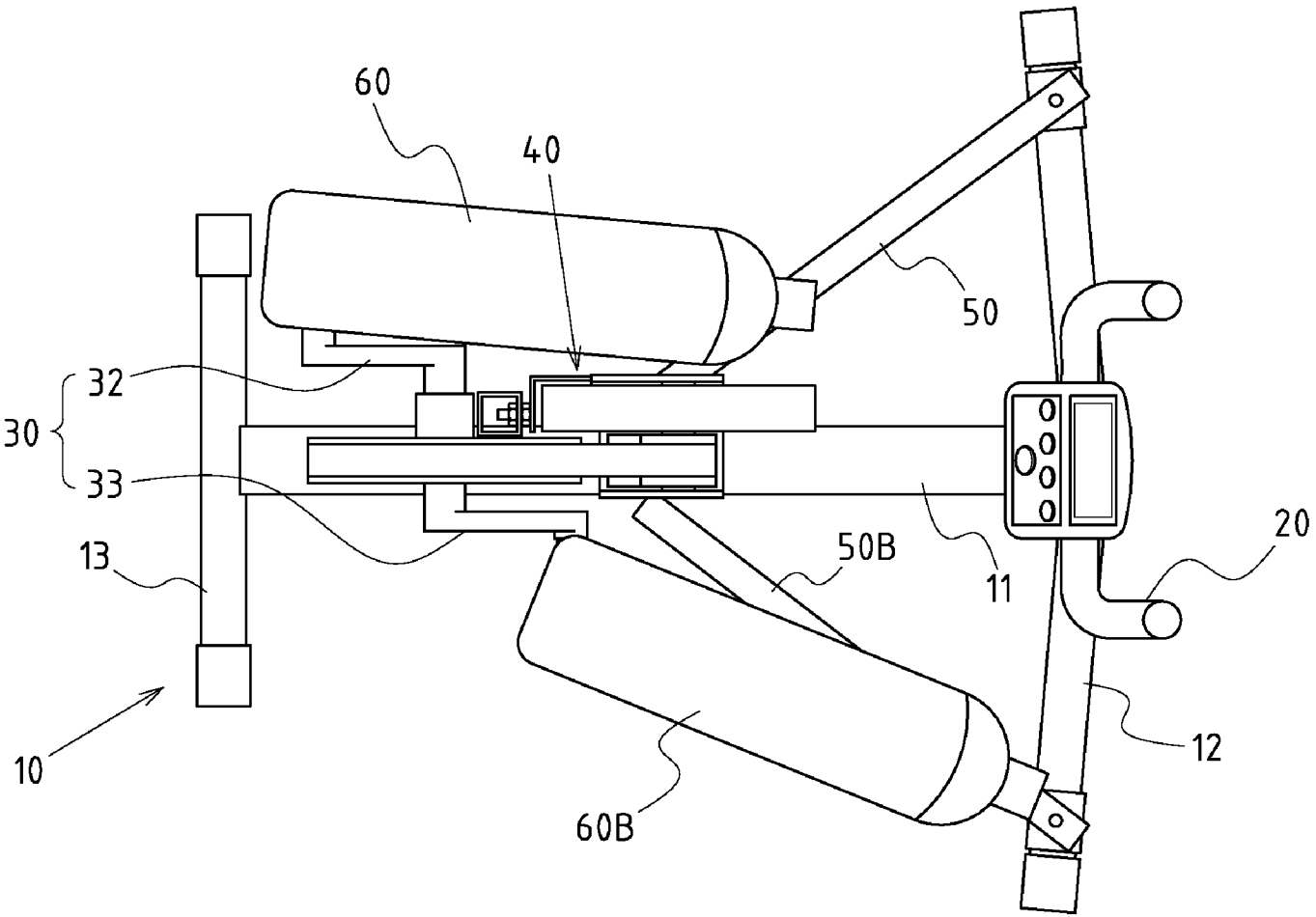
FIG. 3 is a plan top view of the elliptical exercise apparatus of the present invention.

FIGS. 1-3 show the preferred embodiment of the elliptical exercise apparatus of the present invention. The elliptical exercise apparatus A includes a pedestal 10 having a middle support 11, a front support 12 and rear support 13. In this preferred embodiment, the middle support 11, front support 12 and rear support 13 of the pedestal 10 are configured into an I-shaped pattern. The front support 12 is configured into a bow-shaped pattern.

An armrest 20 is arranged vertically onto the front support 12 of the pedestal 10 for the users.

A crank mechanism 30 is arranged onto the middle support 11 of the pedestal 10. The crank mechanism 30 includes a middle shaft 31 as well as a left crank 32 and a right crank 33 separately located at both ends of the middle shaft 31. The left and right cranks 32, 33 are in a staggered state.

A damping device 40 is arranged onto the middle support 11 of the pedestal 10, and meshed with the crank mechanism 30. The damping device 40 comprises a flywheel 41, a resisting wheel 42 and a coupled belt 43 used to connect the flywheel 41 and the resisting wheel 42. The center of the flywheel 41 is mated with the middle shaft 31 of the crank mechanism 30.

Two sloping guide rails 50 and 50B are arranged symmetrically between the front support 12 and middle support 11 of the pedestal 10. One end of two sloping guide rails 50 connecting the front support 12 is arranged laterally.

Two pedals 60 and 60B are arranged separately onto two sloping guide rails 50, 50B, and also connected with the crank mechanism 30. The front bottom of two pedals 60 is fitted with a steerable slide guide 70 that is incorporated onto two sloping guide rails 50, 50B in a gliding state. Moreover, the rear bottom of two pedals 60, 60B is fitted with a universal joint 80 that is connected with two and right cranks 32, 33 of the crank mechanism 30.

Figure 4:
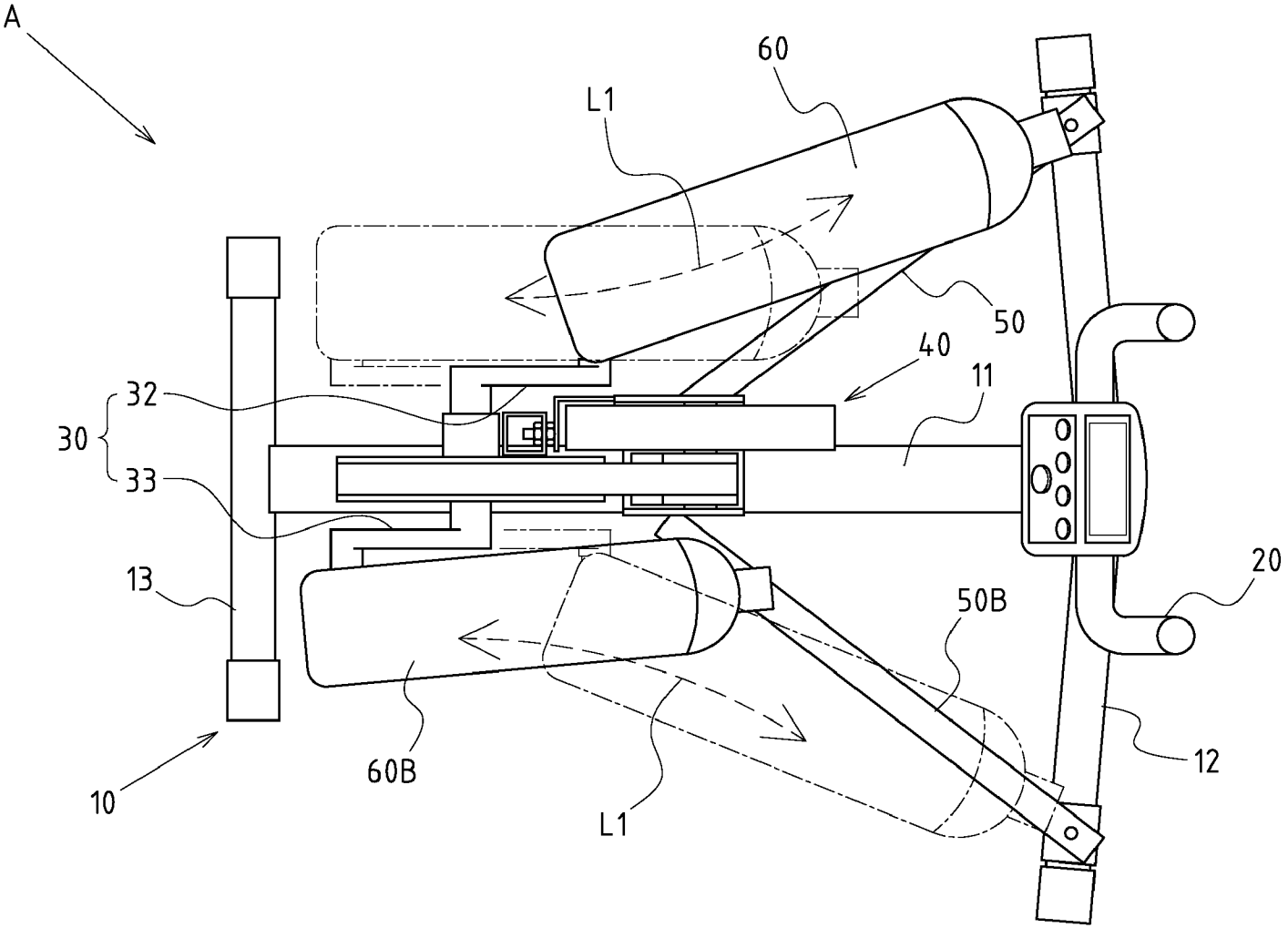
FIG. 4 is a schematic view of the pedals of the present invention (plan top view).

Based on the aforementioned structural configuration, when these two pedals 60, 60B are treaded, its rear end moves circularly under the drive of left and right cranks 32, 33. As shown in FIG. 4, the front end of two pedals 60, 60B can generate reciprocating and torsional swinging movement under the action of two sloping guide rails 50, 50B (indicated by arrow L1).

Of which, two sloping guide rails 50 and 50B may be coupled securely with the front support 12 and middle support 11 (e.g. by means of welding, riveting and screwing), or combined in a removable state (e.g.: bolting, insertion and snapping).

Figure 5:
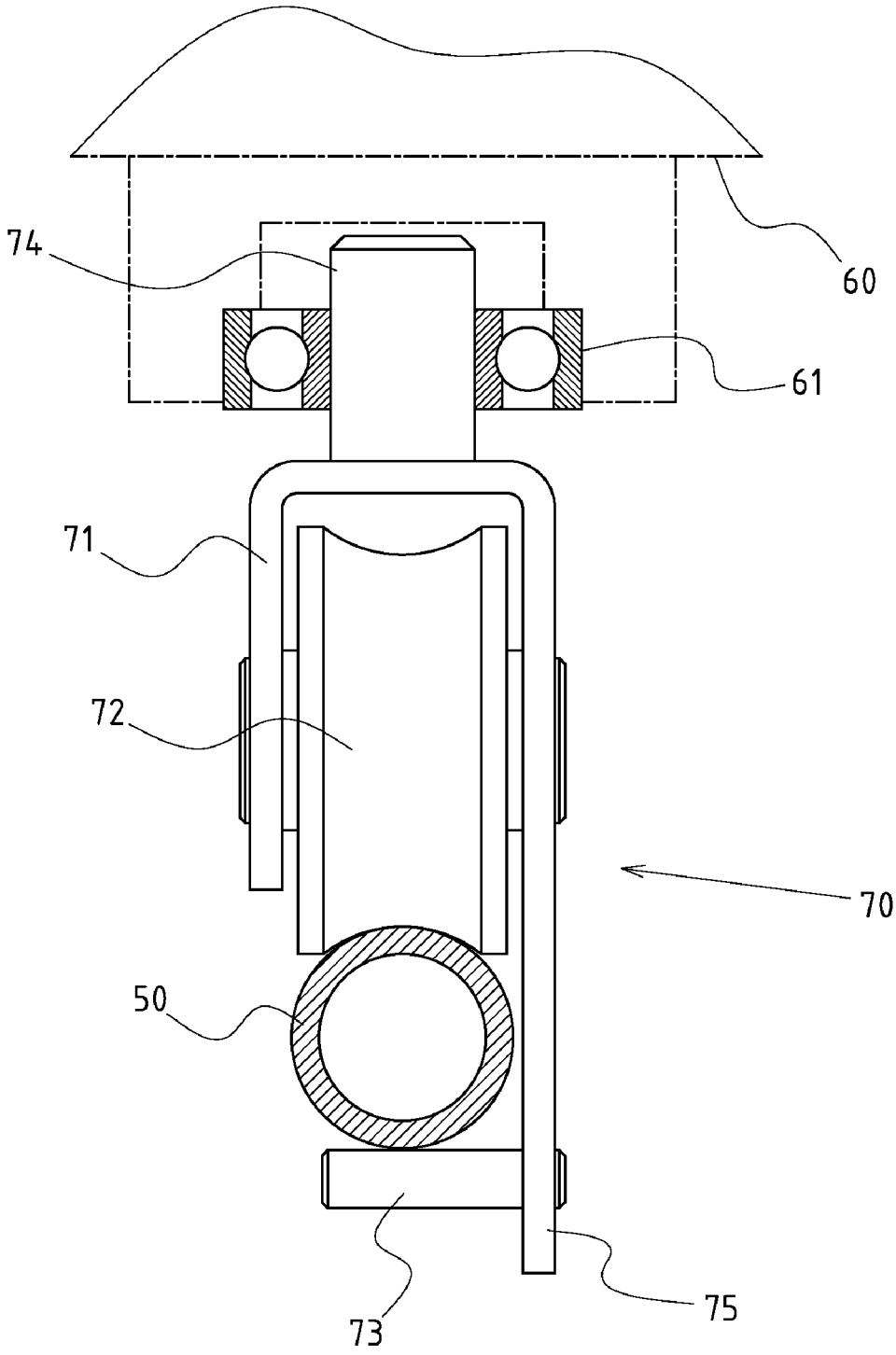
FIG. 5 is a sectional view of the preferred embodiment of the sloping guide rail and slide guide of the present invention.

Referring to FIG. 5, the sloping guide rail 50 (or 50B) is of a round tube (or rod); the slide guide 70 set at front bottom of the pedal 60 (or 60B) comprises of a □-shaped frame 71, a roller 72 and a limiting post 73. Of which, a bearing block 61 is preset at front bottom of the pedal 60 (or 60B). A mating post 74 is protruded from top of □-shaped frame 71 and pivoted into the bearing block 61. The roller 72 is pivoted into the □-shaped frame 71, and the bottom of the roller 72 is abutted onto the sloping guide rail 50 (or 50B). A flange 75 is extended from one side of the □-shaped frame 71 until below the sloping guide rail 50 (or 50B), such that the limiting post 73 is transversely mated with the flange 75, and also abutted onto the bottom of the sloping guide rail 50 (or 50B).

Figure 7:
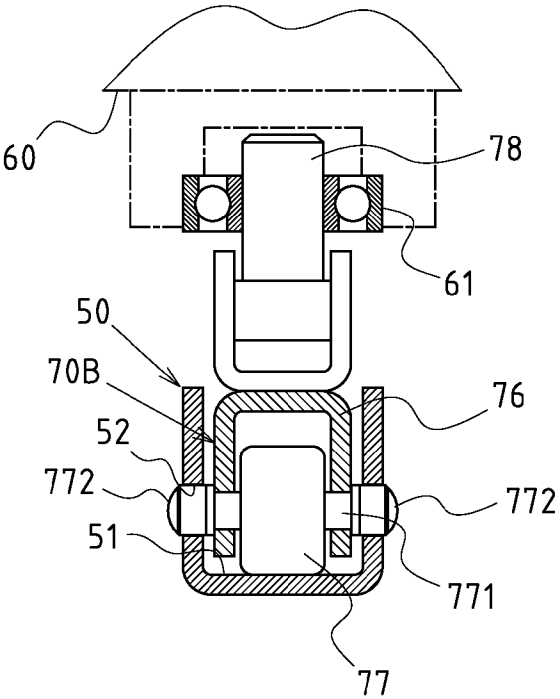
FIG. 7 is another lateral sectional view of the structure disclosed in FIG. 6.
Figure 6:
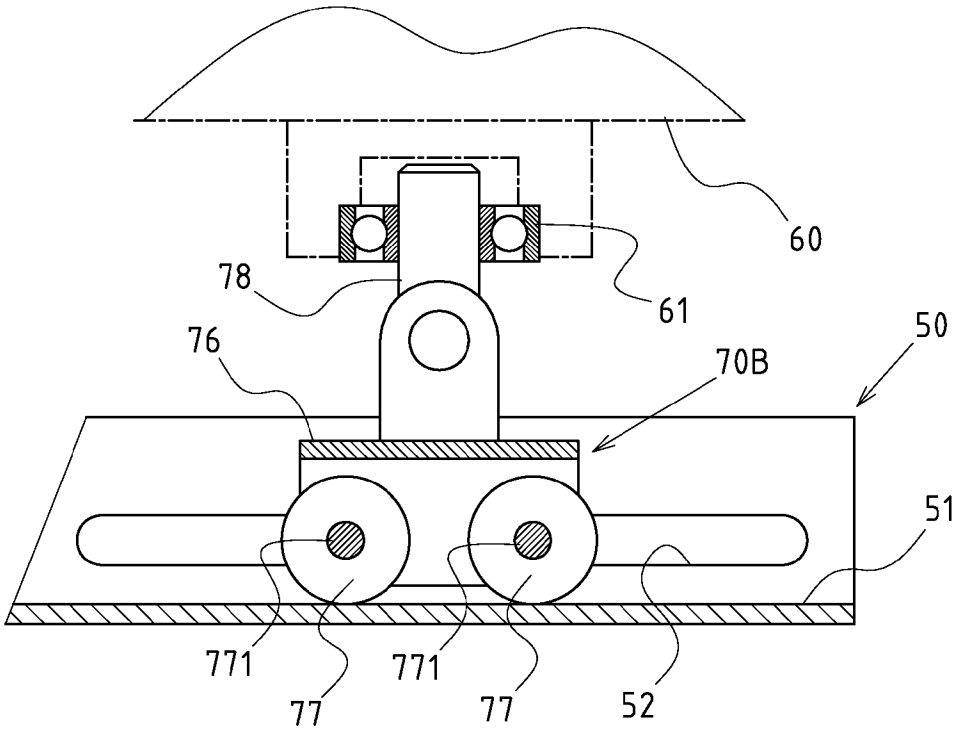
FIG. 6 is a sectional view of another preferred embodiment of the sloping guide rail and slide guide of the present invention.

Referring to FIGS. 6 and 7, the sloping guide rail 50 (or 50B) is also configured into a rail of ⊔-shaped profile to define an inward slot 51, an elongated spacing hole 52 is arranged at two lateral walls of the inward slot 51. The slide guide 70B set at front bottom of the pedal 60 (or 60B) comprises of a framework 76 and two runners 77. A bearing block 61 is preset at front bottom of the pedal 60 (or 60B). A connecting post 78 is protruded from the top of the framework 76 and pivoted into the bearing block 61. The framework 76 and runner 77 of the slide guide 70B are accommodated into the inward slot 51 of the sloping guide rail 50 (or 50B). A domed surface 772 set externally onto the axle center of said runner 77 is penetrated into the elongated spacing hole 52 at two lateral walls of the inward slot 51 for limitation purposes.

Referring to FIG. 2, the universal joint 80 set at rear bottom of the pedals 60, 60B comprises a bearing 81, a transverse cylinder 82 and a vertical post 83. Of which, the bearing 81 is embedded into the rear bottom of the pedals 60, 60B. The transverse cylinder 82 is sleeved onto a column 84 preset at the end of left and right cranks 32, 33 of the crank mechanism 30. The vertical post 83 is vertically set at a top of the transverse cylinder 82, and the top of the vertical post 83 is pivoted into the bearing 81. The rear bottom of the pedals 60, 60B are connected with the left/right cranks 32, 33 with the freedom of transverse and vertical movements, so that the pedals 60, 60B can be adapted to circular and torsional swinging movements.

Figure 8:
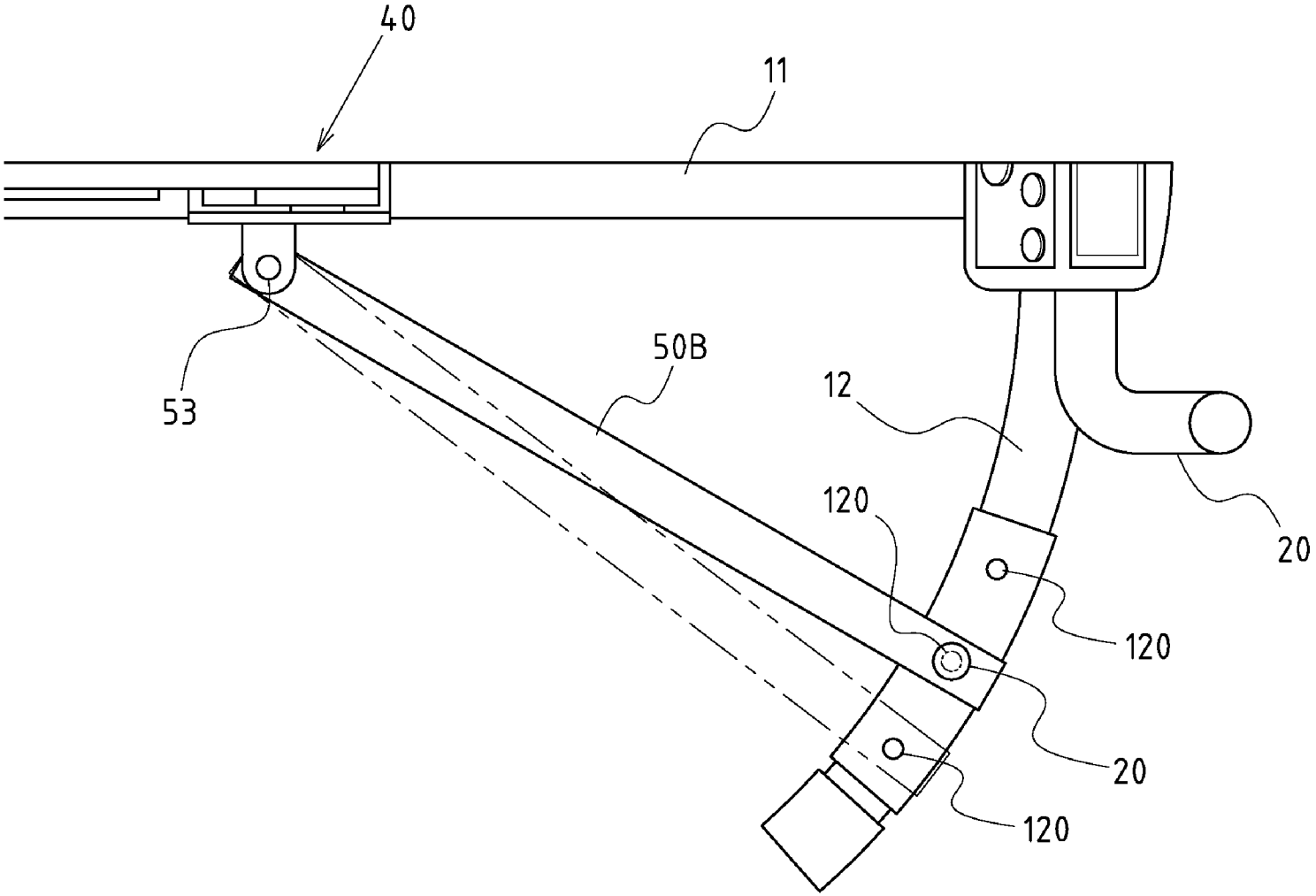
FIG. 8 is a schematic view of the present invention wherein the sloping guide rail is available with multi-section adjustable function.

Referring also to FIG. 8, the sloping guide rail 50B (note: the sloping guide rail 50 is also of the same construction) can be combined with the front support 12 and middle support 11 at multiple sections in an adjustable state. Said adjustable state covers either an adjustable oblique angle or an adjustable height, or both. In this figure, the rear end of the sloping guide rail 50B is connected with the middle support 11 via a pivot 53, such that the front end of the sloping guide rail 50B can be adjusted in a transversely swinging state. Moreover, multiple locating holes 120 (e.g. punch holes) are arranged at intervals on the front support 12, and the front end of the sloping guide rail 50B can be aligned selectively with different locating holes 120 to change the oblique angle, and then positioned by the bolt 121. With this configuration, the magnitude of the pedals' oblique movements can be changed to meet different user demands.

Figure 9:
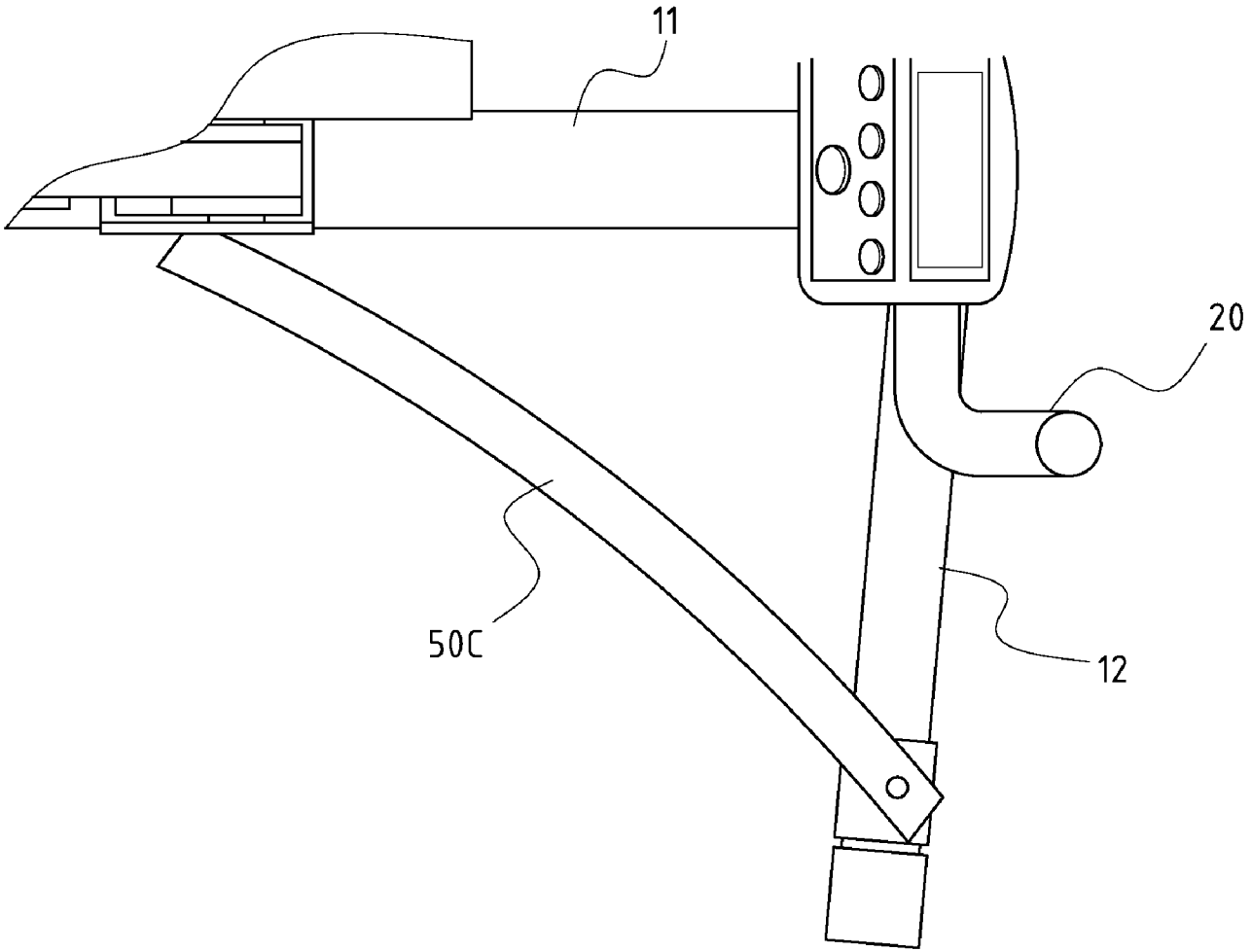
FIG. 9 is a schematic view of the present invention wherein the sloping guide rail is configured into an arched pattern.

Of which, the sloping guide rails 50, 50B are configured into an upright pattern (shown in FIGS. 1-4). Or, referring to FIG. 9, the sloping guide rail 50C is configured into an arched pattern.

The invention claimed is:

1. An elliptical exercise apparatus comprising:

a pedestal having a front support and a rear support and a middle support, said front support and said rear support extending transversely relative to said middle support;

a crank mechanism arranged on said middle support, said crank mechanism having a left crank and a right crank affixed to opposite ends of a middle shaft, said left crank being staggered relative to said right crank;

a damping device arranged onto said middle support, said damping device being meshed with said crank mechanism;

a pair of sloping guide rails arranged symmetrically between and extending between said front support and said middle support, one end of said pair of sloping guide rails arranged laterally;

a pair of pedals respectively arranged onto said pair of sloping guide rails, said pair of pedals connected to said crank mechanism;

a slide guide steerably positioned at a front bottom of said pair of pedals, said slide guide slidably mated onto said pair of sloping guide rails; and a universal joint positioned at a rear bottom of said pair of pedals and connected with said left crank and said right crank, said left crank and said right crank driving said rear bottom of said pair of pedals so as to move in a arcuate pattern and in which a front end of said pair of pedals has a reciprocating and torsional swinging movement by said pair of sloping guide rails.

2. The elliptical exercise apparatus of claim 1, wherein said middle support and said front support and said rear support of the pedestal have an I-shaped pattern.

3. The elliptical exercise apparatus defined in claim 2, wherein said front support has a bow-shape.

4. The elliptical exercise apparatus of claim 1, wherein said pair of sloping guide rails are be coupled securely with the front support and said middle support.

5. The elliptical exercise apparatus of claim 1, wherein said pair of sloping guide rails are removably connected to said front support and said middle support.

6. The elliptical exercise apparatus of claim 5, wherein said pair of sloping guide rails are adjustably connected to said front support and said middle support.

7. The elliptical exercise apparatus of claim 1, wherein the sloping guide rail is a round tube or a rod, said slide guide has an inverted U-shaped frame, a roller and a limiting post of a bearing block is set at said front bottom of the pedal, a mating post is protruded from top of said inverted U-shaped frame and pivoted into said bearing block, the roller is pivoted into said inverted U-shaped frame, a bottom of said roller is abutted onto the sloping guide rail, a flange is extended from one side of said inverted U-shaped frame below the sloping guide rail such that said limiting post is transversely mated with said flange.

8. The elliptical exercise apparatus of claim 1, wherein the sloping guide rail is a rail of a ⊔-shaped profile so as to define an inward slot, an elongated spacing hole is arranged at a pair of lateral walls of said inward slot, the slide guide comprises a framework and pair of runners, a bearing block is set at said front bottom of the pedal, a connecting post is protruded from a top of said framework and pivoted into said bearing block, the framework and the runner of said slide guide are accommodated into said inward slot of the sloping guide rail.

9. The elliptical exercise apparatus of claim 1, wherein said universal joint comprises a bearing, a transverse cylinder and a vertical post, said bearing is embedded into said rear bottom of the pedals, said transverse cylinder is sleeved onto a column set at an end of said left crank and said right crank, said vertical post is vertically set at a top of said transverse cylinder, a top of said vertical post is pivoted into said bearing.

10. The elliptical exercise apparatus of claim 1, wherein said damping device comprises a flywheel, a resisting wheel and a coupled belt, said coupled belt connecting said flywheel and said resisting wheel, the center of said flywheel is mated with said middle shaft of said crank mechanism.

11. The elliptical exercise apparatus of claim 1, wherein an armrest is arranged vertically onto said front support of said pedestal.

12. The elliptical exercise apparatus of claim 1, wherein said pair of sloping guide rails are in an upright shape.

13. The elliptical exercise apparatus of claim 1, wherein said pair of sloping guide rails are arranged in an arched shape.

* * * * *